United States Patent [19]

Cavil

[11] Patent Number: 4,486,181

[45] Date of Patent: Dec. 4, 1984

[54] MARINE PROPULSION DEVICE INCLUDING THRUST BUSHING ANODE

[75] Inventor: David T. Cavil, Menomonee Falls, Wis.

[73] Assignee: Outboard Marine Corporation, Waukegan, Ill.

[21] Appl. No.: 365,295

[22] Filed: Apr. 5, 1982

[51] Int. Cl.[3] ..... B63H 1/14

[52] U.S. Cl. ..... 440/49; 440/78; 440/900; 416/93 A; 416/134 R; 416/146 R; 416/247 A

[58] Field of Search ..... 440/49, 76, 78, 900; 204/196, 197; 416/93 A, 93 M, 134 R, 247 A, 244 B, 146 R

[56] References Cited

U.S. PATENT DOCUMENTS 3,330,751 7/1967 Warner ..... 204/196
4,146,448 3/1979 Nakano et al. ..... 204/197
4,236,872 12/1980 Metcalf ..... 416/93 A

*Primary Examiner*—Trygve M. Blix
*Assistant Examiner*—Edwin L. Swinehart
*Attorney, Agent, or Firm*—Michael, Best & Friedrich

[57] ABSTRACT

A marine propulsion device is provided including a lower unit having a gearcase and a propeller shaft housing located in the gearcase and supporting a propeller shaft for rotation. A propeller is mounted on the propeller shaft rearward portion for common rotation with the propeller shaft. A thrust bushing is carried by the propeller shaft and for transmitting forward thrust from the propeller to the propeller shaft. An annular sacrificial anode surrounds the propeller shaft and is positioned between the thrust bushing and the propeller shaft bearing housing for providing cathodic protection for the rearward end of the gearcase and the propeller shaft bearing housing.

5 Claims, 2 Drawing Figures

MARINE PROPULSION DEVICE INCLUDING THRUST BUSHING ANODE

FIELD OF THE INVENTION

The invention relates generally to marine propulsion devices such as outboard motors and stern drive units. More particularly, the invention relates to attaching anodes to marine propulsion devices to provide cathodic protection.

BACKGROUND PRIOR ART

Corrosive effects which occur due to electrolytic action when two dissimilar metals are immersed in an electrolyte such as seawater, are well known. Such corrosive effects have been noted, for example, in ships and in parts of marine propulsion systems used in saltwater.

Examples of prior art patents relating to electrolytic action and to various means for reducing the corrosive effects of electrolysis in saltwater include the Warner U.S. Pat. No., 3,330,751, issued July 11, 1967; the Gruber U.S. Pat. No. 3,169,504, issued Feb. 16, 1965; the Harms et al. U.S. Pat. No. 4,196,064, issued Apr. 1, 1980; and the Byrd U.S. Pat. No. 3,240,180, issued Mar. 15, 1966.

Attention is also directed to the Metcalf U.S. Pat. No. 4,236,872, issued Apr. 8, 1975, which illustrates the construction of the lower units of prior art marine propulsion devices.

SUMMARY OF THE INVENTION

The invention includes a marine propulsion device comprising a lower unit including a gearcase, a propeller shaft rotatably journaled in the gearcase and including a portion extending rearwardly of the gearcase, a propeller mounted on the propeller shaft rearward portion for common rotation with the propeller shaft and including a forward portion adjacent the rearward end of the gearcase. Means are further included for providing cathodic protection for the rearward end of the gearcase, the cathodic protection means including an annular sacrificial anode surrounding the propeller shaft and positioned between the propeller and the gearcase, and the anode being supported so as to be rotatable with respect to the lower unit.

The invention also includes a marine propulsion device comprising a lower unit including a gearcase having a hollow interior and a rearward end. A propeller shaft is rotatably journaled in the gearcase and includes a portion extending rearwardly of the gearcase. A propeller shaft housing is located in the gearcase and supports the propeller shaft for rotation. A propeller is mounted on the propeller shaft rearward portion for common rotation with the propeller shaft, the propeller including a forward portion adjacent the rearward end of the gearcase. A thrust bushing is carried by the propeller shaft in forward thrust transmitting engagement with the propeller shaft and in forward thrust receiving engagement with the propeller. Means are further included for providing cathodic protection for the rearward end of the gearcase and the propeller shaft bearing housing, the cathodic protection means including an annular sacrificial anode surrounding the propeller shaft and being positioned between the thrust bushing and the propeller shaft bearing housing.

In one preferred embodiment of the invention the annular sacrificial anode is fixed to the thrust bushing.

In one preferred form of the invention the annular sacrificial anode is comprised of zinc.

In a preferred form of the invention the propeller shaft is comprised of steel, and at least one of the gearcase and the propeller shaft bearing housing is comprised of aluminum, and the annular sacrificial anode is comprised of a metal having an electromotive reactivity which is greater than the electromotive reactivity of aluminum.

Other features and advantages of the invention will become known by reference to the following description, to the appended claims and to the drawings.

Figure 1:
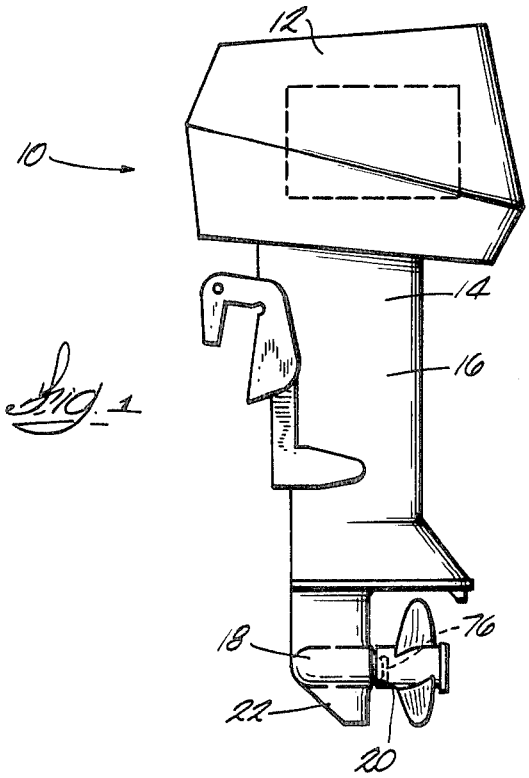
FIG. 1 is a side elevation view of a marine propulsion device embodying the invention.

Before explaining at least one of the embodiments of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

DESCRIPTION OF A PREFERRED EMBODIMENT

Illustrated in FIG. 1 of the drawings is a marine propulsion device 10, such as an outboard motor or a stern drive unit, including a power head 12 and a lower unit 14 which, preferably, is mounted for both horizontal steering movement and vertical tilting movement.

The lower unit 14 includes a drive shaft housing 16 which, at its lower end, terminates in a gearbox or gearcase 18 which includes a hollow interior and which terminates rearwardly at a rearwardly facing gearcase edge or surface 20. Extending below the gearcase is a skeg 22.

Figure 2:
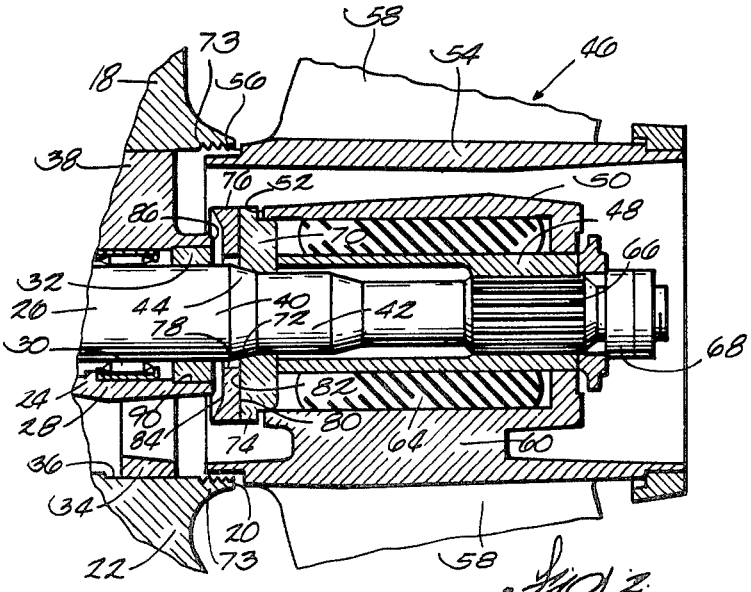
FIG. 2 is a fragmentary side elevation view, partially in section, of the marine propulsion device illustrated in FIG. 1.

As shown in FIG. 2, suitably fixed within the gearcase 18 is a bearing housing or retainer 24 rotatably supporting a propeller shaft 26 which includes a rearward portion extending aft of the retainer 24 and the gearcase 18. The bearing retainer 24 can be fixed to the gearcase in any suitable manner, as disclosed, for instance, in the Kashmerich U.S. Pat. No. 3,937,073 issued Feb. 10, 1976. The bearing retainer 24 includes a central hub portion 28 which supports one or more bearings 30, as for instance, a series of roller bearings and rearwardly of the bearings, a lubricant seal 32 between the retainer 24 and the propeller shaft 26.

The retainer 24 also includes an outer annular portion 34 which engages a part of the cylindrical inner surface 36 of the gearcase 18 and which is supported from the central hub portion by one or more equiangularly spaced ribs 38. The area between the inner or central hub portion 28, the outer annular portion 34 and between the ribs 38 defines a plurality of openings or apertures or passage through which exhaust gases and engine cooling water are discharged from the drive shaft housing 16.

The propeller shaft portion extending rearwardly of the bearing retainer 24 and gearcase 18 includes a forward part 40 having a first diameter, a rearward part 42 having a second diameter less than the first diameter, and a thrust receiving transition part 44 which is located between the forward part 40 and rearward part 42 and which, in the disclosed construction, is conical in formation, but could be of other configurations.

Mounted on the rearward portion of the propeller shaft 26 and rearwardly of the thrust receiving part 44 is a propeller 46 which includes an inner hub 48 received on the propeller shaft 26, together with an outer hub assembly which includes an intermediate hub 50 having a forward end 52 and an outer hub 54 having a forward end 56 which can be stepped as shown and which extends somewhat into the hollow interior of the gearcase 18 in close proximity to the inner cylindrical surface 36. The outer hub assembly also includes a series of propeller blades 58 extending from the outer hub 54, and a series of equiangular spaced ribs or spokes 60 which interconnect the intermediate and outer hubs and which define a plurality of exhaust gas and engine cooling water discharge passages which communicate with the apertures in the bearing retainer 24. The outer hub assembly is connected to the inner hub 48 by a resilient cushion or member 64 so as to absorb shock and to permit a limited amount of relative rotation between the inner hub 48 assembly and outer hub assembly.

Any suitable means, as for instance, a spline connection 66, can be employed to provide for common rotation of the propeller shaft 26 and the inner hub 48 of the propeller 46. Any suitable means can be employed, such as a nut 68 to retain the propeller 46 on the propeller shaft 26 and to provide for transmission of reverse thrust from the intermediate hub of the propeller 46 to the propeller shaft 26.

Forward propeller thrust is transmitted from the propeller 46 to the propeller shaft 26 through a thrust bushing 70. More particularly, the thrust bushing 70 includes a central or hub portion which is apertured to permit passage therethrough of the propeller shaft 26, which aperture is defined, in part, by a thrust transmitting surface 72 which engages the thrust receiving part 44 of the propeller shaft 26 for transmission of forward thrust from the thrust bushing 70 to the propeller shaft.

In a preferred form of the invention the lower gearcase 18 and the propeller shaft bearing housing 24 are comprised of a material such as aluminum or other metal. Since these parts are in close proximity to the propeller shaft 26 and the thrust bushing 70, which are each comprised of stainless steel, the gearcase 18 and the propeller shaft bearing housing 24 are each likely to corrode due to galvanic action when the marine propulsion device is operated in saltwater.

The galvanic action occurs where metallic parts comprised of two different metals such as steel and aluminum are immersed in an electrolyte such as seawater. In the lower unit of a marine propulsion device as shown in FIG. 2 where the propeller shaft 26 and thrust bearing 70 are comprised of stainless steel, these parts form a cathode. Adjacent structures formed from metals such as zinc or aluminum will function as an anode. Close proximity of the anodic and cathodic parts will result in rapid dissolution of the anodic part. Since the lower gearcase 18 and bearing housing 24 are constructed of aluminum, those portions of the gearcase and bearing housing immersed in saltwater and adjacent the thrust bushing 70 and the propeller shaft 26 will tend to function as anodes and to corrode rapidly.

Means are provided for reducing the tendency of the rearward lip 73 of the gearcase 18 and the propeller shaft bearing housing 24 from corroding due to galvanic action. This means includes a sacrificial anode 76 comprised of a material such as zinc. The sacrificial anode comprises a ring or circular zinc plate having a central aperture 78 adapted to house the propeller shaft 26. In the illustrated construction, the anode 76 surrounds the propeller shaft and includes a central aperture 78 larger than the diameter of the propeller shaft 26. The sacrificial anode includes one planar face 80 fixed to the forward face 82 of the thrust bushing, and a forward face 84 spaced rearwardly of the bearing housing 24 but positioned adjacent the rearward surface 86 of the bearing housing. While the anode 76 could be secured to the thrust bushing in various ways, in one preferred form of the invention, the anode 76 is fixed to the thrust bushing by screws (not shown).

As shown in the drawings, both the thrust bushing 70 and the anode 76 are sized so as not to materially interfere with exhaust gas flow from the gearcase to the propeller.

While the sacrificial anode 76 has been described as being comprised of zinc, in other embodiments it could be comprised of other suitable metals or alloys of the type which would provide protection of the gearcase and bearing housing from galvanic couples caused by the presence of dissimilar metals in an electrolyte.

In operation of the sacrificial anode, when the propeller shaft 26 and thrust bushing 70 are submersed in electrolyte and function as cathodes, the sacrificial anode 76 will corrode rather than the gearcase 18 or the bearing housing 24.

Galvanic corrosion of the propeller shaft bearing housing 24 can have a particularly adverse effect. Such corrosion can result in failure of the fluid tight seal between the seal 32 and the internal bore 90 of the propeller shaft bearing housing 24. Failure of that seal can result in leakage of water into the gearcase 18 and contamination of the lubricant therein and eventual failure of the gears in the gearcase. Accordingly, it is particularly important that corrosion of the bearing housing 24 be controlled.

One of the advantages of the present invention and of providing an annular sacrificial anode 76 mounted on the thrust bushing 70, is that the thrust bushing 70 is easily removed and replaced if maintenance is required or if substitution of a new sacrificial anode 76 is necessary.

Another advantage of the arrangement of the invention arising from the relatively easy replacement of the sacrificial anode 76 is that the sacrificial anode may be supplied as an accessory to the marine propulsion device 10 where the propulsion device is to be used in saltwater. Propulsion devices used in fresh water are not subjected to the corrosive effects of electrolytic action to the extent that is caused by saltwater and may not require a sacrificial anode 76 as described above.

Another advantage of the invention is that the sacrificial anode is particularly positioned as to protect the bearing housing 24 and the rearward lip 73 of the gearcase 18 from corrosion. In those cases where other sacrificial anodes are located in other places on the lower unit 14, the propeller 46 has been found to have a shielding effect and to reduce the effectiveness of those anodes from protecting the bearing housing 24 and the surrounding portions of the lower unit from corrosion.

Various features of the invention are set forth in the following claims.

I claim:

1. A marine propulsion device comprising a lower unit including a gearcase having a hollow interior including an open rearward end, a bearing retainer fixed in said hollow interior of said gearcase and including therein an exhaust passage communicating with the exhaust port of an internal combustion engine, bearing means mounted in said retainer, a propeller shaft rotatably mounted in said bearing means and having a portion extending rearwardly of said gearcase, a propeller in adjacent relation to said gearcase and including an inner hub mounted on said rearward portion of said propeller shaft for common rotation therewith, an outer hub supporting a plurality of propeller blades, and an exhaust passage located between said inner and outer hubs and communicating with said exhaust passage in said bearing retainer, a thrust bushing carried by said propeller shaft and located between said bearing retainer and said inner hub without interfering with exhaust gas flow from said bearing retainer exhaust passage to said propeller exhaust passage, and a sacrificial anode located between said thrust bushing and said bearing retainer without interfering with exhaust gas flow from said bearing retainer exhaust passage to said propeller exhaust passage, whereby to provide cathodic protection for said open rearward end of said gearcase and said bearing retainer.

2. A marine propulsion device as set forth in claim 1 wherein said sacrificial anode is annular and is fixed to said thrust bushing.

3. A marine propulsion device as set forth in claim 1 wherein said thrust bushing includes a surface facing said bearing retainer and wherein said sacrificial anode is fixed to said surface of said thrust bushing.

4. A marine propulsion device as set forth in claim 1 wherein said sacrificial anode is comprised of zinc.

5. A marine propulsion device as set forth in claim 1 wherein said propeller shaft is comprised of steel, wherein at least one of said gearcase and said bearing retainer are comprised of aluminum, and wherein said sacrificial anode is comprised of a metal having an electromotive reactivity which is greater than the electromotive reactivity of aluminum.

* * * * *